United States Patent [19]

Byrne

[11] Patent Number: 4,653,290

[45] Date of Patent: Mar. 31, 1987

[54] BEER KEG ICE SLEEVE AND METHOD OF MAKING SAME

[76] Inventor: Shelley R. Byrne, 13 Cedar Grove Rd., Rolla, Mo. 65401

[21] Appl. No.: 877,891

[22] Filed: Jun. 24, 1986

[51] Int. Cl.[4] ..... F25D 3/08

[52] U.S. Cl. ..... 62/372; 62/400; 62/457; 62/530; 383/38

[58] Field of Search ..... 62/400, 457, 372, 530, 62/398; 220/DIG. 1, DIG. 14, 466, 467; 383/38, 901

[56] References Cited

U.S. PATENT DOCUMENTS

| | | | |
|---|---|---|---|
| 3,443,397 | 5/1969 | Donovan et al. | 62/400 X |
| 3,614,875 | 10/1971 | McCallun | 62/400 X |
| 4,514,993 | 5/1985 | Johnson | 62/372 |

*Primary Examiner*—Lloyd L. King
*Attorney, Agent, or Firm*—Richard G. Heywood

[57] ABSTRACT

An ice sleeve cooler for beer kegs or other beverages comprising a slip-over ice sleeve open at the bottom and open at the top and having inner and outer sleeve members with an ice pocket therebetween. The bottom of the sleeve members are joined in sealed relation and have a draw-string for attachment around the lower side wall of the keg, and both inner and outer sleeve members have top draw-strings for individually attaching these members to the keg. The method of fabricating the ice sleeve cooler from a one-piece sheet of plastic stock involves the steps of folding and sealing the sheet to form the double sleeve members with an integral bottom edge.

12 Claims, 8 Drawing Figures

BEER KEG ICE SLEEVE AND METHOD OF MAKING SAME

BACKGROUND OF THE INVENTION

In the past various forms of ice coolers have been provided for beer kegs and other beverage containers such as ponies, quarter barrel, half barrel, tappers and the like. Conventionally kegs or barrels have been cooled in washtubs or like rigid, floored containers that are heavy, awkward to transport and expensive. Other cooler constructions to encase a keg or barrel in ice have generally utilized a bottom floor and side wall within which the keg is fitted and ice pockets have been provided around the side of the keg. Such coolers have had limited success as alternatives to the bathtub concept of beverage cooling by immersion in an ice-filled container. For example, U.S. Pat. Nos. 3,443,397 and 3,614,875 disclose beer keg coolers utilizing a flexible double-liner bucket encasing the bottom and side of the keg, and providing no arrangement for disposing of water produced by ice melt. U.S. Pat. No. 4,514,993 discloses a keg encircling sleeve with a series of pockets to receive so-called "blue ice" bags that are pre-frozen, but discloses no arrangement for securing the sleeve to the keg so that it can be easily moved. Such prior art coolers of varying construction have been fairly complex structures and have not received wide-spread acceptance.

SUMMARY OF THE INVENTION

Briefly, the present invention provides an economical ice sleeve cooler for beer kegs or the like which may be simply slipped over and firmly attached to the keg and filled with ice. The ice sleeve cooler is easily fabricated from a single rectangular sheet of impermeable flexible plastic or the like and only seaming and folding are employed to provide a substantially cylindrical dual liner sleeve of tubular configuration, open at the top and bottom, and having channels for draw-strings to position and secure the ice sleeve to the keg.

The ice sleeve is freely slipped over the top and around the keg and secured around the keg top by draw-strings for the inner and outer dual liners and adjacent to the keg bottom by another draw-string. An ice pocket is formed between the inner and outer sleeve liner members open at the top for reception of ice cubes, chipped ice or the like, and a drain valve is provided at the lower portion of the outer liner.

The ice sleeve cooler through its easy assembly over the keg and rapid securing lends itself to use by the general public having no access to tools or the like. The sleeve cooler does not interfere with the operation of the keg dispensing hardware and, since it is secured to the lower side wall of the keg, provides a free unfettered keg bottom so that it may be moved along the ground without damage to the ice sleeve cooler.

Another object of the present invention is to provide an inexpensive keg cooler that is strong, lightweight, leak proof, and foldable for easy storage, and which is easily manufactured from a one-piece sheet stock member.

Another object is to provide a keg cooler that attaches in a manner to provide efficient cooling, easy replacement of ice fill and which is not affected by sliding or moving the keg from place to place.

These and other objects of this invention will appear in the detailed description which follows.

BRIEF DESCRIPTION OF THE DRAWINGS

In the accompanying drawings, which form a part of the specification and disclose preferred embodiments, and wherein like numerals refer to like parts wherever they occur.

DESCRIPTION OF THE INVENTION

Figure 1:
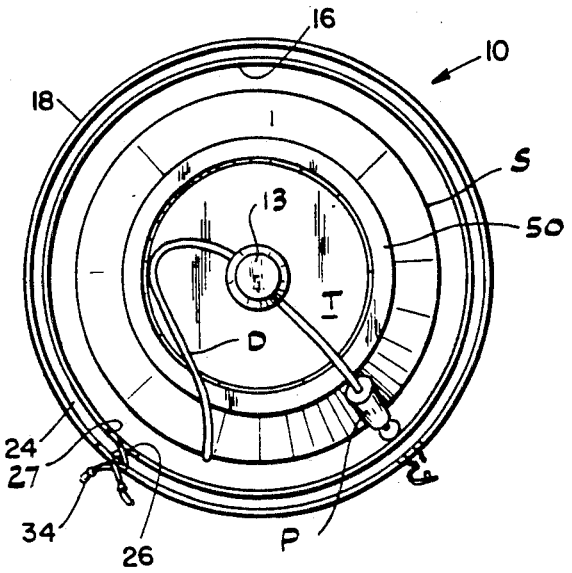
FIG. 1 is a top plan view of a cooler sleeve embodying the invention shown in place around a beer keg prior to attachment thereto.

The beer keg ice sleeve of the present invention is generally indicated by the reference number 10, and is shown in use with a conventional beer keg 12 of quarter barrel or half barrel size for disclosure purposes. Typically, such keg or barrel 12 for beer or other beverage is integrally formed from metal, and has a bulging side wall S and recessed top and bottom end walls T and B joined to the side wall by annular rims or chimes 50 and 52, respectively. The side wall S is usually formed with annular shoulders 54 and 56 adjacent to the top and bottom rims 50 and 52 or, in some constructions, outwardly formed annular strengthening bands or ribs (not shown) may be formed to define similar annular shoulders. The barrel 12 has a tap 13 in the top end wall T to which a hand pump P is connected for pressurizing the contents, and a dispensing tube D with end valve V also connects to the tap 13 through which the contents are dispensed.

Figure 2:
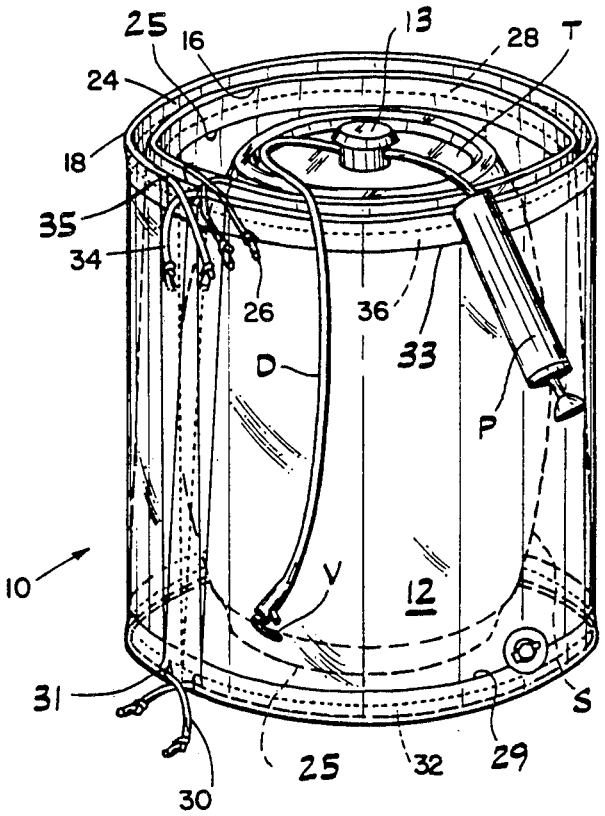
FIG. 2 is a perspective view of the cooler sleeve in the position of FIG. 1.
Figure 3:
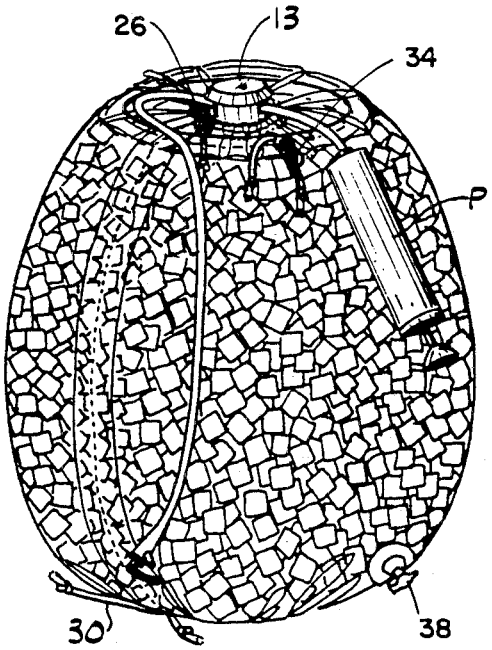
FIG. 3 is a front elevational view of the cooler sleeve shown attached around the keg and in its iced condition.
Figure 4:
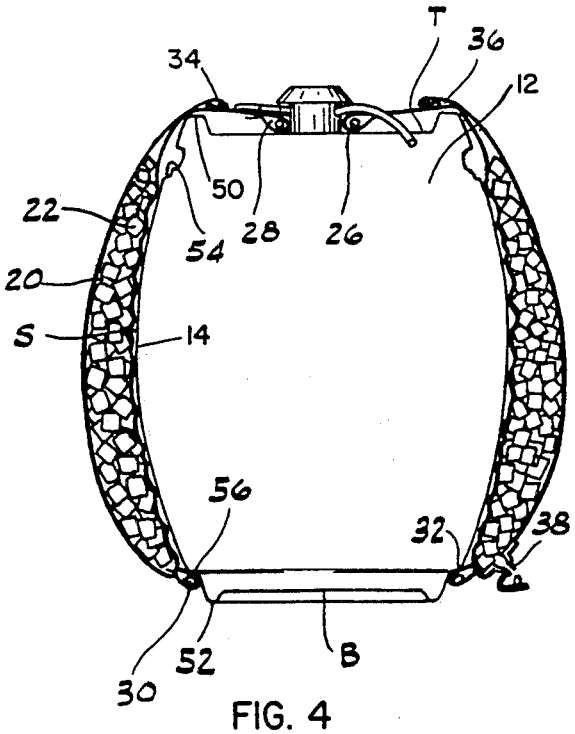
FIG. 4 is a vertical cross-sectional view of the iced cooler sleeve attached around the keg and showing an open drain.

The ice sleeve cooler 10 is tubular in construction and comprises an inner sleeve member 16 and an outer sleeve member 18 which are integrally formed or sealably connected together at the bottom and open at the top to provide an inner pocket 20 which is adapted to be top loaded with ice cubes or the like 22 through a circumferential annular opening 24 best shown in FIGS. 1 and 2.

In order to secure the ice sleeve 10 to the top of the beer keg 12, the open upper margin 25 of the inner sleeve member or liner 16 is folded over and hemmed or sealed to define an open channel or tunnel 28 to receive a draw-string 26, and the channel 28 has an opening 27 through which the ends of the draw-string 26 extend outwardly to be grasped for closing.

The lower margins 29 of the inner and outer sleeve members 16 and 18 are sealed together or integrally formed according to the method of this invention and are folded over to define an open channel 32 to receive a draw-string 30, the ends of which extend out of channel 32 through opening 31.

A third draw-string 34 is employed at the top margin 33 of the outer sleeve liner 18 and extends through an open channel 36 therein for closing the top opening 24 of the ice pocket 20 when it is filled with ice. This draw-string extends out of the channel 36 through opening 35.

All of the draw-strings are preferably of nylon or similar low friction material to provide ease in drawing the draw-strings tight. The inner and outer sleeve liners 16 and 18 are preferably constructed of impermeable flexible sheet plastic, but it will be understood that water-proof canvas or the like may be employed as desired.

The outer sleeve member 18 is provided with a drain valve 38 adjacent to the lower portion 29 of the ice sleeve 10 to provide for drainage of accumulated melt water from the ice pocket 20.

Figure 5:
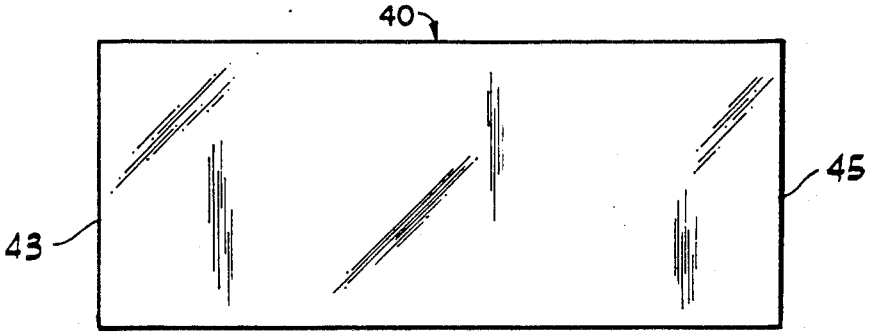
FIG. 5 is a plan view of the sheet stock material used in fabrication.
Figure 6:
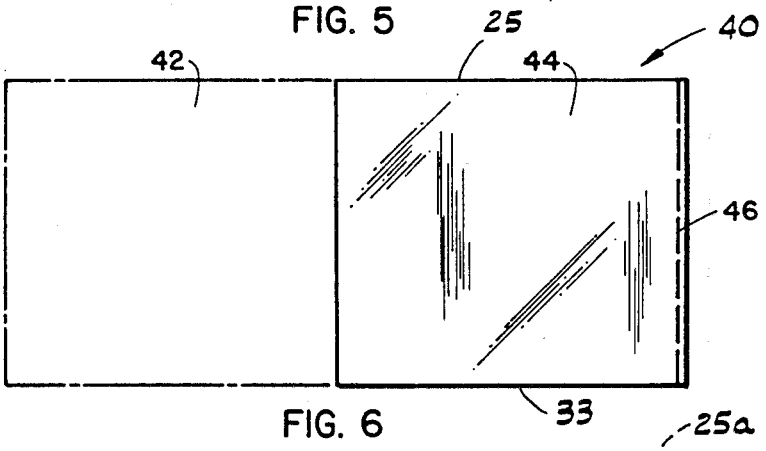
FIGS. 6–8 are diagrammatic illustrations of the stages of fabrication of the ice sleeve cooler of the present invention.
Figure 7:
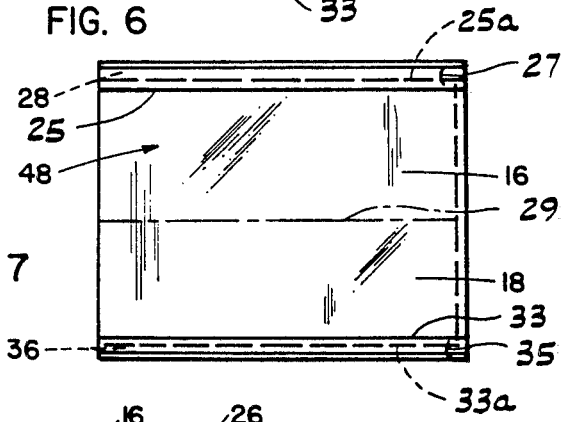
Figure 8:
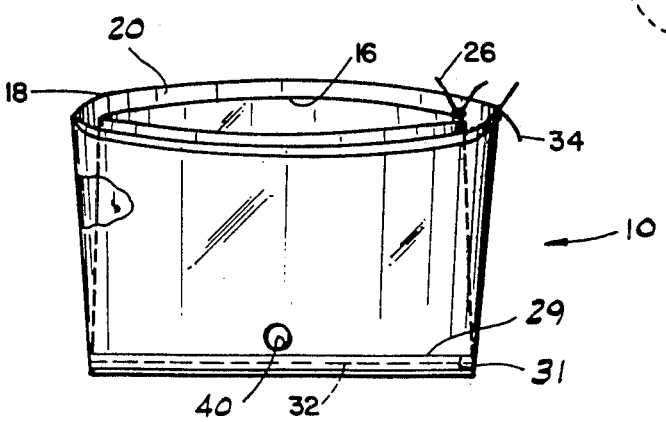

The method of making the ice sleeve 10 from a single rectangular sheet of moisture impermeable material 40, FIG. 5, involves the fabrication steps illustrated in FIGS. 6, 7 and 8.

In the first stage of FIG. 6, the left half 42 of the rectangular sheet 40 is folded longitudinally in half over the right half to bring the free vertical margins 43 and 45 together, and these margins are stitched or bonded together, at 46, to form a primary, intermediate tubular sleeve 48, FIG. 7, having open upper and lower marginal edges 25 and 33. The vertical seam may be sealed by heat or adhesive to make it waterproof.

In the next stage shown in FIG. 7, the upper marginal edge 25 is hemmed over by seam 25*a* to form channel 28 and opening 27 is provided thereto to accommodate the upper draw-string 26 for the top of the inner sleeve member 16, and the lower marginal edge 33 is similarly hemmed over by seam 33*a* to form channel 36 and opening 35 is provided thereto for accommodating the draw-string 34 for the top of the outer sleeve member 18.

In the third stage shown in FIG. 8, the lower portion of the primary tubular sleeve 48 is turned and folded longitudinally and pulled up upon itself around the upper portion intermediate of the channel margins 28 and 36 to position the outer sleeve member 18 around the inner sleeve member 16 so that these members have a common integral bottom margin or fold (along broken line 29 in FIG. 7). Thus, the channel margins 28 and 36 are brought substantially into the same upper plane, and the bottom sealed pocket 20 is formed between the inner and outer members 16 and 18. The common integral bottom fold (29) is then hemmed to form the bottom channel 32 having opening 31 thereto to accommodate bottom draw-string 30. All of the channel seams may be formed by appropriate stitching and heat sealing or other bonding as necessary to form waterproof closures.

The draw-strings 26, 30 and 34 may be inserted in their respective channel seams through the access openings at any stage in the fabrication. The drain valve or plug 38 may be applied to a bottom opening 40 in the outer sleeve liner 18 by heat sealing a peripheral flange thereto, and this provides for appropriate drainage of water from the ice pocket 20 as necessary.

The beer keg sleeve 10 of this invention is very simple in construction and use on various types of beer kegs or containers for other beverages where cooling is desired, and particularly on kegs of the ¼ or ½ barrel size. Different sized ice sleeves may be provided for the ¼ and ½ barrels or other size of beverage kegs and are circumferentially larger to slip over and around the keg in spaced relation therewith.

In use, the ice sleeve 10 freely slips over and around the side wall S of the keg 12 and the bottom draw-string 30 is then tightened on the lower side wall S, under shoulder 56, to secure the ice sleeve 10 above the bottom rim 52. The draw-string 26 of the inner sleeve member 16 is then tightened and tied over the top rim 50 adjacent to the tap 13 and below the pump and dispensing tube.

The pocket 20 of the ice sleeve cooler 10 is then filled with ice 22 through the top opening 24. This filling operation causes the inner sleeve liner 16 to bulge inwardly and bear against the keg side wall S for direct heat exchange and efficient cooling, and which further holds the ice sleeve against the keg. After the ice fill, the outer sleeve liner 18 is then closed by tightening and tying the draw-string 34 over the upper rim 50 of the keg 12 to complete attachment of the cooler 10 for chilling the beverage contents. It will be understood that the ice sleeve cooler 10 may be applied to a cylindrical keg (not shown) by first tightening the draw-string 26 of the inner sleeve member 16 over the keg top rim 50 which thus locates the bottom margin and lower draw-string 30 thereof above the bottom rim (52) of the keg and holds the ice sleeve cooler 10 in place.

The dispensing of cold beer or other beverage from the keg 12 is carried out in a conventional manner by pressurizing the contents with pump P and using the dispenser valve V connected to the tap in the top wall T of the keg. The bottom rim 52 of the keg 12 is free so that it may be tilted and rolled or slid along the floor for repositioning without ground contact or otherwise disturbing the ice sleeve cooler 10. Whenever desired, water melt from the ice pocket 20 may be simply drained by opening the drain valve 38, and the ice fill 22 can be replenished merely by loosening the outer draw-string 34 to open the ice pocket 20. When the ice sleeve 10 is no longer needed for cooling, it is simply untied and drained, and it may be folded or collapsed for convenient storage until needed again.

It will be apparent to those skilled in the art that changes and modifications can be made in the present invention which is only limited by the scope of the claims appended hereto.

What is claimed is:

1. An ice sleeve cooler for a beverage keg comprising an impermeable, flexible inner sleeve member having open top and bottom margins and being circumferentially larger than a keg to be cooled whereby said inner sleeve member freely fits over and around the keg in circumscribing spaced relation, an impermeable, flexible outer sleeve member having an open top margin and a bottom margin joined circumferentially and in sealed relation to the bottom margin of said inner sleeve member, said inner and outer sleeve members defining an annular ice receiving pocket therebetween accessible between the top margins of said inner and outer sleeves, first closure means for securing the sealed bottom margins of said sleeve members around the keg adjacent to the bottom thereof, second closure means for securing the top margin of said inner sleeve member around the top of the keg, and third closure means for securing the top margin of said outer sleeve member around the top of the keg when said annular pocket has been filled with ice.

2. The ice sleeve cooler according to claim 1, in which said first closure means is adapted to secure said sealed bottom margins of said inner and outer sleeve members to the side wall of the keg in spaced relation above the bottom thereof.

3. The ice sleeve cooler according to claim 1, in which said second and third closure means comprise circumferential channel means formed at the top margins of said inner and outer sleeve members, and a draw-string in each of said channel means.

4. The ice sleeve cooler according to claim 3, in which said first closure means also comprises another circumferential channel formed at said sealed bottom margins of said sleeve members, and a draw-string in said other circumferential channel.

5. The ice sleeve cooler according to claim 1, in which drain means are provided in said outer sleeve member adjacent to the bottom margin thereof.

6. The ice sleeve cooler according to claim 1, in which said inner and outer sleeve members form a tubular central chamber circumferentially larger than the keg to be cooled, and said chamber being open at both the top and bottom to permit placement of said ice sleeve cooler over the keg in situ and in circumscribing relation therewith for attachment by said first and second closure means prior to ice fill.

7. The ice sleeve cooler according to claim 1, in which said sleeve cooler is constructed from flexible, moisture impermeable plastic material, and said closure means comprise draw-string means formed of low friction material.

8. The method of making an ice sleeve cooler for a beverage container from a one-piece blank of flexible, moisture impermeable material, comprising the steps of folding the blank in half and sealing the free marginal edges opposite to the fold to provide a primary tubular sleeve open at both ends, folding and turning said primary tubular sleeve on itself intermediate of said open ends to bring said open ends together at the top and form inner and outer sleeve members having a closed bottom fold whereby a top opening annular pocket is formed between said inner and outer sleeve members and said inner and outer sleeve members together define a tubular central chamber with open top and bottom to receive a beverage container therein, providing first means for closing the bottom opening of the central chamber, and providing other means for selectively closing the open top ends of each of said inner and outer sleeve members.

9. The method according to claim 8, in which said first means is provided by hemming the bottom fold to form a bottom channel having an opening thereto, and positioning a draw-string in said channel with end portions extending outwardly through the opening.

10. The method according to claim 8, in which said other means is provided by hemming the open top end of each of said inner and outer sleeve members to form top channels therein and providing an opening in each top channel, and positioning a draw-string in each top channel with end portions extending outwardly through the opening thereto.

11. The method according to claim 8, including the further step of forming an opening in the outer sleeve member adjacent to the bottom fold, and attaching a drain valve over said opening.

12. The method of making a tubular ice sleeve cooler for a barrel-type beverage container from a single rectangular sheet of flexible, moisture impermeable plastic stock, comprising the steps of folding the sheet stock longitudinally in half and sealably joining the free marginal edges opposite to the fold to provide a continuous primary tubular sleeve having open upper and lower marginal edges, hemming the upper and lower marginal edges to define first and second channels therein and providing an opening into each of said first and second channels, folding said primary tubular sleeve on itself longitudinally intermediate of said hemmed upper and lower marginal edges to form inner and outer sleeve members having an integral bottom fold and positioning said first and second channels in substantially the same upper plane to define a top opening annular pocket between said inner and outer sleeve members, hemming said integral bottom fold to define a third channel and providing an opening thereto, and providing draw-string means within each of said first, second and third channels having end portions extending outwardly through the respective channel openings.

* * * * *